US012313349B2

(12) United States Patent
Huang et al.

(10) Patent No.: US 12,313,349 B2
(45) Date of Patent: May 27, 2025

(54) MICRO-CHANNEL HEAT EXCHANGER

(71) Applicant: ZHEJIANG DUNAN ARTIFICIAL ENVIRONMENT CO., LTD., Shaoxing (CN)

(72) Inventors: Hongbo Huang, Shaoxing (CN); Yu Sun, Shaoxing (CN); Huangang Yu, Shaoxing (CN)

(73) Assignee: ZHEJIANG DUNAN ARTIFICIAL ENVIRONMENT CO., LTD., Shaoxing (CN)

( * ) Notice: Subject to any disclaimer, the term of this patent is extended or adjusted under 35 U.S.C. 154(b) by 209 days.

(21) Appl. No.: 17/887,457

(22) Filed: Aug. 14, 2022

(65) Prior Publication Data

US 2022/0390187 A1 Dec. 8, 2022

Related U.S. Application Data

(63) Continuation of application No. PCT/CN2020/136128, filed on Dec. 14, 2020.

(30) Foreign Application Priority Data

Feb. 18, 2020 (CN) ..... 202020181497.2

(51) Int. Cl.
*F28F 1/10* (2006.01)
*F28D 1/053* (2006.01)
*F28F 1/02* (2006.01)

(52) U.S. Cl.
CPC ..... *F28F 1/022* (2013.01); *F28D 1/05366* (2013.01); *F28F 2260/02* (2013.01)

(58) Field of Classification Search
CPC .... F28F 1/022; F28F 2260/02; F28D 1/05366
(Continued)

(56) References Cited

U.S. PATENT DOCUMENTS 5,366,007 A * 11/1994 Hutto ..... F28F 9/0224 165/173
2006/0185824 A1* 8/2006 Harada ..... F28F 9/001 165/149
2019/0301810 A1* 10/2019 Finstad ..... F28F 3/025

FOREIGN PATENT DOCUMENTS

CN 1203355 A * 12/1998
CN 201133783 Y 10/2008
(Continued)

OTHER PUBLICATIONS

International Search Report of PCT/CN2020/136128.
Request for the Submission of an Opinion of KR1020227027365.

*Primary Examiner* — Davis D Hwu

(57) ABSTRACT

The present disclosure provides a micro-channel heat exchanger including two collecting pipes, and a plurality of flat pipes and two side plates that are arranged between the two collecting pipes, wherein the two side plates are located on two outer sides of the flat pipes and are defined as a first side plate and a second side plate respectively; fins are respectively arranged between the first side plate and the adjacent flat pipe and between the second side plate and the adjacent flat pipe; and the outer side of the first side plate and/or the second side plate is provided with a blocking part at a position close to the collecting pipe, and the blocking part can prevent composite material on the collecting pipe from flowing to a middle part of the first side plate and/or the second side plate.

16 Claims, 3 Drawing Sheets

(58) Field of Classification Search
USPC ..... 165/172
See application file for complete search history.

(56) References Cited

FOREIGN PATENT DOCUMENTS

| | | | | |
|---|---|---|---|---|
| CN | 101870023 | A | | 10/2010 |
| CN | 201740441 | U | | 2/2011 |
| CN | 202255037 | U | | 5/2012 |
| CN | 202284877 | U | | 6/2012 |
| CN | 102914202 | A | | 2/2013 |
| CN | 202902968 | U | | 4/2013 |
| CN | 202915788 | U | | 5/2013 |
| CN | 202915805 | U | | 5/2013 |
| CN | 203837337 | U | * | 9/2014 |
| CN | 204063513 | U | | 12/2014 |
| CN | 205352170 | U | | 6/2016 |
| CN | 205580246 | U | | 9/2016 |
| CN | 206618315 | U | | 11/2017 |
| CN | 208186919 | U | | 12/2018 |
| JP | 2006234199 | A | | 9/2006 |
| JP | 2009150566 | A | | 7/2009 |
| KR | 1020020027182 | A | | 4/2002 |

* cited by examiner

MICRO-CHANNEL HEAT EXCHANGER

CROSS-REFERENCE TO RELATED APPLICATIONS

This application is a continuation of PCT patent application PCT/CN2020/136128 filed on Dec. 14, 2020, which claims all benefits accruing from China Patent Application No. 202020181497.2, filed on Feb. 18, 2020 and tilted "MICRO-CHANNEL HEAT EXCHANGER", in the China National Intellectual Property Administration, the contents of which are hereby incorporated by reference.

TECHNICAL FIELD

The present disclosure relates to a field of a heat exchanger, and in particular, to a micro-channel heat exchanger.

BACKGROUND

At present, in a conventional micro-channel heat exchanger, two external fins without a composite layer are provided at outer sides of two side plates, respectively. Therefore, when components of the micro-channel heat exchanger is brazed with a brazing furnace, the two external fins can prevent a width of a core body of the micro-channel heat exchanger from shrinking too much, and occurring in inverted fins.

However, since the side plates are connected to and communicated with collecting pipes of the micro-channel heat exchanger, during the process in which components of the micro-channel heat exchanger are brazed with the brazing furnace, composite material on the collecting pipe will be melted and a part of which will flow to the two side plates, so as to weld the two external fins on the corresponding side plates. Therefore, it is difficult to clean solders between the external fins and the corresponding side plates when the external fins are separated from the corresponding side plates.

SUMMARY

According to various embodiments of the present disclosure, the present disclosure provides a micro-channel heat exchanger. The micro-channel heat exchanger includes two collecting pipes, a plurality of flat pipes and two side plates wherein the plurality of flat pipes and the two side plates are provided between the two collecting pipes, the two side plates are located at two outer sides of the plurality of flat pipes and defined as a first side plate and a second side plate, respectively; and a plurality of fins are provided between the first side plate and one of the plurality of flat pipes adjacent to the first side plate, and between the second side plate and one flat pipe of the plurality of flat pipes adjacent to the second side plate, respectively. The blocking part is further provided at an outer side of the first side plate and/or the second side plate and at a position close to one of the two collecting pipes. The blocking part is capable of preventing a composite material on the collecting pipe from flowing towards a middle part of the first side plate and/or the second side plate.

In some embodiments, the blocking part is a rib.

In some embodiments, the blocking part is a groove.

In some embodiments, a number of the blocking parts provided on the first side plate and/or the second side plate corresponding to each of the two collecting pipes is multiple.

In some embodiments, the blocking part and the corresponding first side plate and/or the second side plate are integrally formed.

In some embodiments, the blocking part is a through hole provided on the first side plate and/or the second side plate.

In some embodiments, the through hole is selected from a circle-shaped hole, an oval-shaped hole, a kidney-shaped hole, or a square-shaped hole.

In some embodiments, the micro-channel heat exchanger comprises a plurality of blocking parts, a part of the plurality of blocking parts are the ribs, and the other part of the plurality of blocking parts are through holes.

In some embodiments, both the first side plate and the second side plate are provided with the blocking part at the position close to at least one of the two collecting pipes.

In some embodiments, a complementary structure is defined by the blocking part at an inner side of the corresponding first side plate and/or the second side plate, and an end portion of one of the plurality of fins abuts against the complementary structure of the corresponding first side plate and/or the second side plate.

The present disclosure has the following advantages compared with a conventional technology. In a micro-channel heat exchanger provided by the present disclosure, a blocking part can prevent composite materials on the collecting pipe from flowing towards a middle part of the side plates. Therefore, during a process in which the micro-channel heat exchanger is brazed with a brazing furnace, an amount of the composite material on the collecting pipe flowing towards positions of the external fins can be reduced, thereby reducing probability of the external fins being welded on the side plates, while reducing the probability of the fins being corroded.

BRIEF DESCRIPTION OF THE DRAWINGS

In order to better describe and explain the embodiments and/or examples of those inventions disclosed herein, one or more drawings may be referred to. The additional details or examples used to describe the drawings should not be considered as limiting the scope of any of the disclosed inventions, the currently described embodiments and/or examples, and the best mode of these inventions currently understood.

In the figures, 10 represents a collecting pipe, 20 represents a side plate, 201 represents a first side plate, 202 represents a second side plate, 30 represents a fin, 101 represents a blocking part, 200 represents an external fin, and 40 represents a flat pipe.

DETAILED DESCRIPTION OF THE EMBODIMENT

The technical solutions in the embodiments of the present disclosure are clearly and completely described in the following with reference to the accompanying drawings in the embodiments of the present disclosure. It is obvious that the described embodiments are only a part of the embodiments, but not all of the embodiments. All other embodiments obtained by those skilled in the art based on the embodiments of the present disclosure without departing from the inventive scope are the scope of the present disclosure.

Unless otherwise defined, all technical and scientific terms used herein have the same meaning as a skilled person in the art would understand. The terminology used in the description of the present disclosure is for the purpose of describing particular embodiments and is not intended to limit the disclosure.

Figure 1:
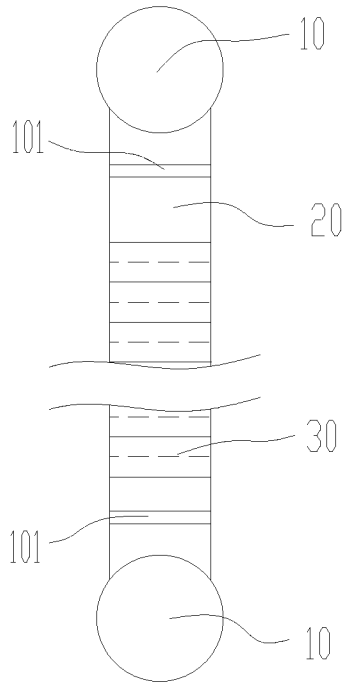
FIG. 1 is a front view of a micro-channel heat exchanger in an embodiment of the present disclosure, wherein a blocking part of the micro-channel heat exchanger is a rib and/or a groove.
Figure 2:
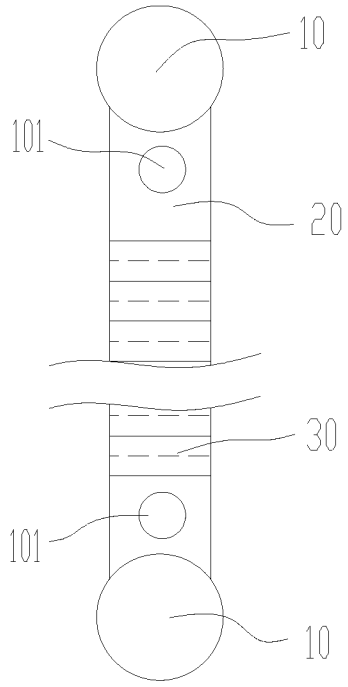
FIG. 2 is a front view of a micro-channel heat exchanger in an embodiment of the present disclosure, wherein a blocking part of the micro-channel heat exchanger is a through hole.
Figure 3:
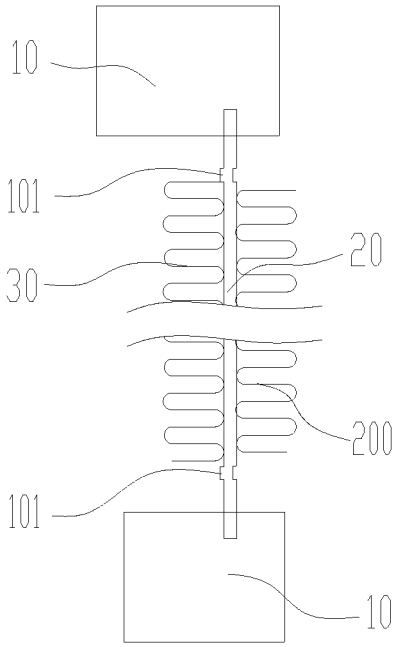
FIG. 3 is a structural schematic view of matching of a micro-channel heat exchanger with external fins in an embodiment of the present disclosure, wherein a blocking part of the micro-channel heat exchanger is a groove.
Figure 4:
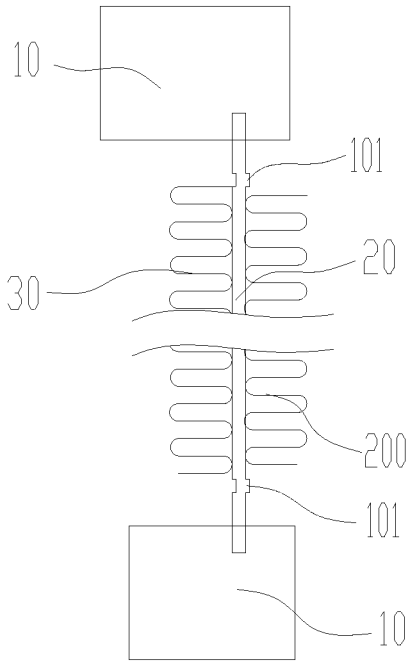
FIG. 4 is a structural schematic view of matching of a micro-channel heat exchanger with external fins in an embodiment of the present disclosure, wherein a blocking part of the micro-channel heat exchanger is a rib.
Figure 5:
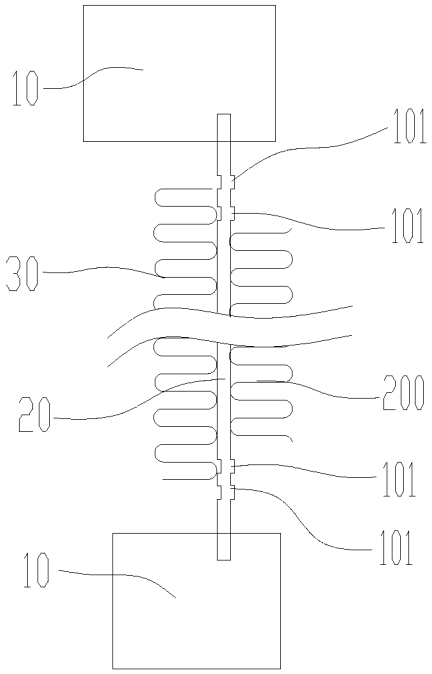
FIG. 5 is a structural schematic view of matching of a micro-channel heat exchanger with external fins in an embodiment of the present disclosure, wherein the micro-channel heat exchanger is provided with a plurality of blocking parts, and the plurality of blocking parts are all ribs.
Figure 6:
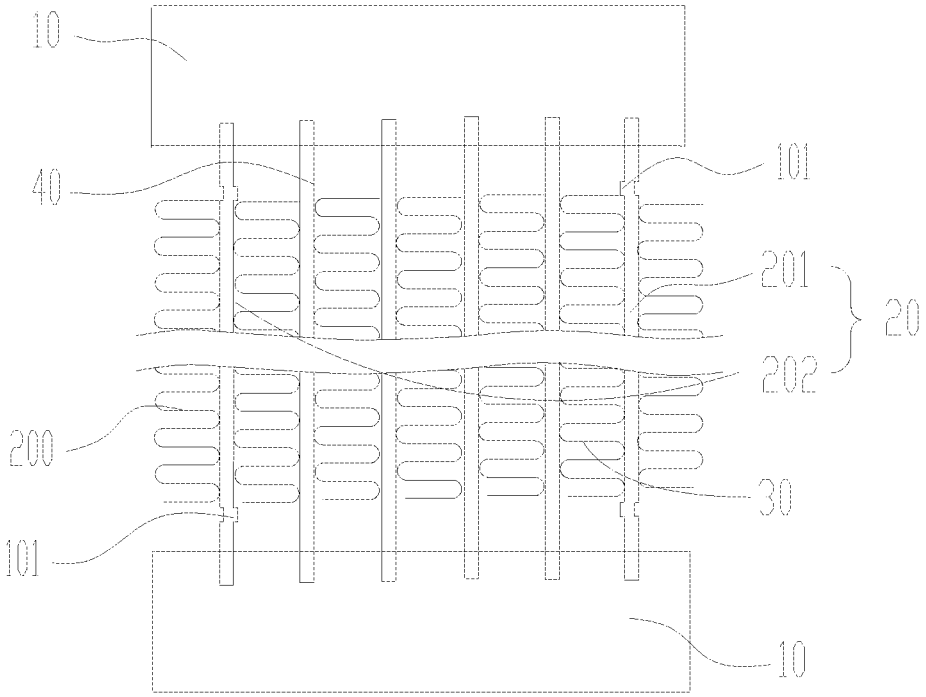
FIG. 6 is a structural schematic view of a micro-channel heat exchanger in an embodiment of the present disclosure.

Referring to FIG. 1 to FIG. 6, a micro-channel heat exchanger, in an embodiment of the present disclosure, can include two collecting pipes 10, a plurality of flat pipes 40 and two side plates 20. The plurality of flat pipes 40 and the two side plates 20 can be provided between the two collecting pipes 10, the two side plates 20 can be located at two outer side of the plurality of flat pipes 40 and defined as a first side plate 201 and a second side plate 202 respectively. A plurality of fins 30 can be provided between the first side plate 201 and the plurality of flat pipes 40 adjacent to the first side plate 201, and between the second side plate 202 and the plurality of flat pipes 40 adjacent to the second side plate 202. It should be noted that in the micro-channel heat exchanger of the present embodiment, the plurality of fins 30 can be also provided between adjacent two of the plurality of flat pipes 40.

In the present embodiment, a blocking part 101 can be further provided at an outer side of the first side plate 201 and/or the second side plate 202 and at a position close to one of the two collecting pipes 10. The blocking part 101 can prevent composite material on the collecting pipe from flowing towards a middle part of the first side plate and/or the second side plate. That is, in the micro-channel heat exchanger of the present embodiment, the first side plate 201 and/or the second side plate 202 can be processed to form the blocking portion 101. The blocking part 101 can prevent composite material on the collecting pipe 10 from flowing towards the plurality of fins 30 and external fins 300 during a process in which the micro-channel heat exchanger is brazed with a brazing furnace. Therefore, during the process in which the micro-channel heat exchanger is brazed with a brazing furnace, an amount of the molten composite material on the collecting pipe 10 flowing towards the plurality of fins 30 and the external fins 200 can be reduced, thereby reducing probability of the external fins 200 being welded on the side plates 20, while reducing the probability of the plurality of fins 30 being corroded. It should be noted that the external fin 200 is an auxiliary tool during an overall production and preparation of the micro-channel heat exchanger. The external fin 200 is configured to prevent width of core body of the micro-channel heat exchanger from shrinking too much, and occurring of inverted fins. The width of the core body of the micro-channel heat exchanger is a width between the first side plate 201 and the second side plate 202. In some embodiments, a first blocking part is provided at an outer side of the first side plate and at a position close to at least one of the two collecting pipes. In some embodiments, a second blocking part is provided at an outer side of the second side plate and at a position close to at least one of the two collecting pipes.

In one embodiment, a number of the blocking parts 101 provided on the first side plate 201 and/or the second side plate 202 corresponding to each of the two collecting pipes can be multiple. However, a number of the blocking parts 101 corresponding to the fin 30 disposed on the first side plate 201 and/or the second side plate 202 can be limited by a distance between the plurality of fins 30 and the collecting pipe 10, which will not be elaborated herein. In the micro-channel heat exchanger of the present embodiment, both the first side plate and the second side plate are provided with the blocking part at the position close to at least one of the two collecting pipes. It should be noted that, the first side plate 201 and/or the second side plate 202 can be provided with one blocking part 101 corresponding to each of the two collecting pipes according to actual needs.

Furthermore, in one embodiment, the blocking part 101 and the corresponding first side plate 201 can be integrally formed, so as to facilitate processing and form the blocking portion 101 on the first side plate 201. In one embodiment, the blocking part 101 and the corresponding second side plate 202 can be integrally formed, so as to facilitate processing and form the blocking portion 101 on the second side plate 202.

In one embodiment, the blocking part 101 can be a rib or a groove. When the blocking part 101 is the groove, a complementary structure can be defined by the blocking part 101 at an inner side of the corresponding first side plate 201, and an end portion of one of the plurality of fins 30 can abut against the complementary structure of the corresponding first side plate 201. In one embodiment, the complementary structure can be defined by the blocking part 101 at an inner side of the corresponding second side plate 201, and an end of another of the plurality of fins 30 can abut against the corresponding second side plate 202.

Furthermore, in the micro-channel heat exchanger provided by the present embodiment, the blocking part 101 can be a through hole provided on the first side plate 201 and/or the second side plate 202. The molten composite material on the collecting pipe 10 can flow into the through hole, thereby realizing a blocking effect on the molten composite material on the collecting pipe 10. The through hole can be a circle-shaped hole, an oval-shaped hole, a kidney-shaped hole, a square-shaped hole, or other irregular shaped holes.

It could be understood that the micro-channel heat exchanger can include a plurality of blocking parts 101, a part of the blocking parts 101 can be the ribs, and the other part can be the through holes. It should be noted that, the blocking part 101 can be any combination of ribs, grooves and through holes according to needs, which will not be elaborated here.

In summary, in the micro-channel heat exchanger provided by the present disclosure, the blocking part 101 can prevent composite material on the collecting pipe 10 from flowing towards a middle part of the side plates 20. Therefore, during a process in which the micro-channel heat exchanger is brazed with a brazing furnace, an amount of the composite material on the collecting pipe 10 flowing towards positions of the external fins 200 can be reduced, thereby reducing probability of the external fins 200 being welded on the side plates 20, while reducing the probability of the fins 30 being corroded.

The technical features of the above-described embodiments may be combined in any combination. For the sake of brevity of description, not all possible combinations of the technical features in the above embodiments are described. However, as long as there is no contradiction between the combinations of these technical features, all should be considered as within the scope of this disclosure.

The above-described embodiments are merely illustrative of several embodiments of the present disclosure, and the description thereof is relatively specific and detailed, but is not to be construed as limiting the scope of the disclosure. It should be noted that a number of variations and modifications may be made by those skilled in the art without departing from the spirit and scope of the disclosure. Therefore, the scope of the disclosure should be determined by the appended claims.

We claim:

1. A micro-channel heat exchanger, comprising two collecting pipes, a plurality of flat pipes and two side plates, wherein the plurality of flat pipes and the two side plates are provided between the two collecting pipes, the two side plates are located at two outer sides of the plurality of flat pipes and defined as a first side plate and a second side plate, respectively; and a plurality of fins are provided between the first side plate and one of the plurality of flat pipes adjacent to the first side plate, and between the second side plate and one flat pipe of the plurality of flat pipes adjacent to the second side plate, respectively, a blocking part is further provided at an outer side of the first side plate and/or the second side plate and at a position close to one of the two collecting pipes, and the blocking part is capable of preventing a composite material on the collecting pipe from flowing towards a middle part of the first side plate and/or the second side plate, the blocking part is spaced from the collecting pipe, and the blocking part and the corresponding first side plate and/or the second side plate are an integral structure, wherein a complementary structure is defined by the blocking part at an inner side of the corresponding first side plate and/or the second side plate, and an end portion of one of the plurality of fins abuts against the complementary structure of the corresponding first side plate and/or the second side plate.

2. The micro-channel heat exchanger of claim 1, wherein the blocking part is a rib.

3. The micro-channel heat exchanger of claim 1, wherein the blocking part is a groove.

4. The micro-channel heat exchanger of claim 1, wherein a number of the blocking parts provided on the first side plate and/or the second side plate corresponding to each of the two collecting pipes is multiple.

5. The micro-channel heat exchanger of claim 1, wherein both the first side plate and the second side plate are provided with the blocking part at the position close to at least one of the two collecting pipes.

6. A micro-channel heat exchanger, comprising two collecting pipes, a plurality of flat pipes and two side plates, wherein the plurality of flat pipes and the two side plates are provided between the two collecting pipes, the two side plates are located at two outer sides of the plurality of flat pipes and defined as a first side plate and a second side plate, respectively; and a plurality of fins are provided between the first side plate and one of the plurality of flat pipes adjacent to the first side plate, and between the second side plate and one flat pipe of the plurality of flat pipes adjacent to the second side plate, respectively, a blocking part is further provided at an outer side of the first side plate and/or the second side plate and at a position close to one of the two collecting pipes, and the blocking part is capable of preventing a composite material on the collecting pipe from flowing towards a middle part of the first side plate and/or the second side plate, the blocking part is spaced from the collecting pipe, and the blocking part and the corresponding first side plate and/or the second side plate are an integral structure, wherein the blocking part is a through hole provided on the first side plate and/or the second side plate.

7. The micro-channel heat exchanger of claim 6, wherein the through hole is selected from a circle-shaped hole, an oval-shaped hole, a kidney-shaped hole, or a square-shaped hole.

8. The micro-channel heat exchanger of claim 6, wherein the blocking part is a rib.

9. The micro-channel heat exchanger of claim 6, wherein the blocking part is a groove.

10. The micro-channel heat exchanger of claim 6, wherein a number of the blocking parts provided on the first side plate and/or the second side plate corresponding to each of the two collecting pipes is multiple.

11. The micro-channel heat exchanger of claim 6, wherein both the first side plate and the second side plate are provided with the blocking part at the position close to at least one of the two collecting pipes.

12. A micro-channel heat exchanger, comprising two collecting pipes, a plurality of flat pipes and two side plates, wherein the plurality of flat pipes and the two side plates are provided between the two collecting pipes, the two side plates are located at two outer sides of the plurality of flat pipes and defined as a first side plate and a second side plate, respectively; and a plurality of fins are provided between the first side plate and one of the plurality of flat pipes adjacent to the first side plate, and between the second side plate and one flat pipe of the plurality of flat pipes adjacent to the second side plate, respectively, a plurality of blocking parts are further provided at an outer side of the first side plate and/or the second side plate and at a position close to one of the two collecting pipes, and the plurality of blocking parts are capable of preventing a composite material on the collecting pipe from flowing towards a middle part of the first side plate and/or the second side plate, the plurality of blocking parts are spaced from the collecting pipe, and the plurality of blocking parts and the corresponding first side plate and/or the second side plate are an integral structure, wherein a part of the plurality of blocking parts are ribs, and the other part of the plurality of blocking parts are through holes.

13. The micro-channel heat exchanger of claim 12, wherein the blocking part is a rib.

14. The micro-channel heat exchanger of claim 12, wherein the blocking part is a groove.

15. The micro-channel heat exchanger of claim 12, wherein a number of the blocking parts provided on the first side plate and/or the second side plate corresponding to each of the two collecting pipes is multiple.

16. The micro-channel heat exchanger of claim 12, wherein both the first side plate and the second side plate are provided with the blocking part at the position close to at least one of the two collecting pipes.

* * * * *